United States Patent [19]

Engelfried et al.

[11] Patent Number: 4,571,957

[45] Date of Patent: Feb. 25, 1986

[54] DEVICE FOR COMPENSATING FOR DIFFERENCES IN THERMAL EXPANSION IN CIRCULAR KNITTING MACHINES

[75] Inventors: Werner Engelfried, Sindelfingen; Gerhard Mueller, Esslingen, both of Fed. Rep. of Germany

[73] Assignee: Terrot Strickmaschinen GmbH, Stuttgart, Fed. Rep. of Germany

[21] Appl. No.: 605,767

[22] Filed: May 1, 1984

[30] Foreign Application Priority Data

May 5, 1983 [DE] Fed. Rep. of Germany ..... 3316382

[51] Int. Cl.[4] ..... D04B 15/00

[52] U.S. Cl. ..... 66/115

[58] Field of Search ..... 66/115, 104, 107

[56] References Cited

U.S. PATENT DOCUMENTS

| | | | |
|---|---|---|---|
| 2,104,231 | 1/1938 | Lawson | 66/107 |
| 2,135,187 | 11/1938 | Lawson et al. | 66/107 |
| 3,913,356 | 10/1975 | Suppe | 66/115 |

*Primary Examiner*—Ronald Feldbaum

*Attorney, Agent, or Firm*—Shenier & O'Connor

[57] ABSTRACT

The invention relates to a device for compensating the differences in thermal expansion of the needle cylinder and sinker ring in a circular knitting machine, with which the sinker ring is supported on projections of webs inserted into axially extending grooves in the needle cylinder. In order to compensate for the differences in thermal expansion, the top region of the needle cylinder is designed to be radially displaceable relative to the sinker ring.

11 Claims, 10 Drawing Figures

DEVICE FOR COMPENSATING FOR DIFFERENCES IN THERMAL EXPANSION IN CIRCULAR KNITTING MACHINES

The invention relates to a device for compensating the differences in the thermal expansion of a needle cylinder and a sinker ring in a circular knitting machine, with which the sinker ring is supported on projections of webs inserted into axially extending grooves in the needle cylinder.

During operation of such circular knitting machines the needle cylinder and sinker ring are subject to a very high degree of heat due to the sliding friction resulting from constant movement of the needle and sinker. Temperatures of over 150° C. may be reached. Experience has shown that the temperature of the sinker ring is always below that of the needle cylinder. Due to this difference in temperature, the needle cylinder and the sinker ring rigidly connected to it have differing thermal expansions which may lead to stress and deformation of the sinker cylinder. The sinkers which are slidably displaceable in this ring therefore lose their precise guidance and alignment and this leads to a poorer material quality and cloth appearance.

The object of the invention is to compensate for the differences in the thermal expansion of the needle cylinder and sinker ring in a circular knitting machine and to guarantee an exact sinker guidance and alignment.

The object is accomplished in accordance with the invention in that the top region of the needle cylinder is designed to be radially displacable relative to the sinker ring.

Figures 1, 2:
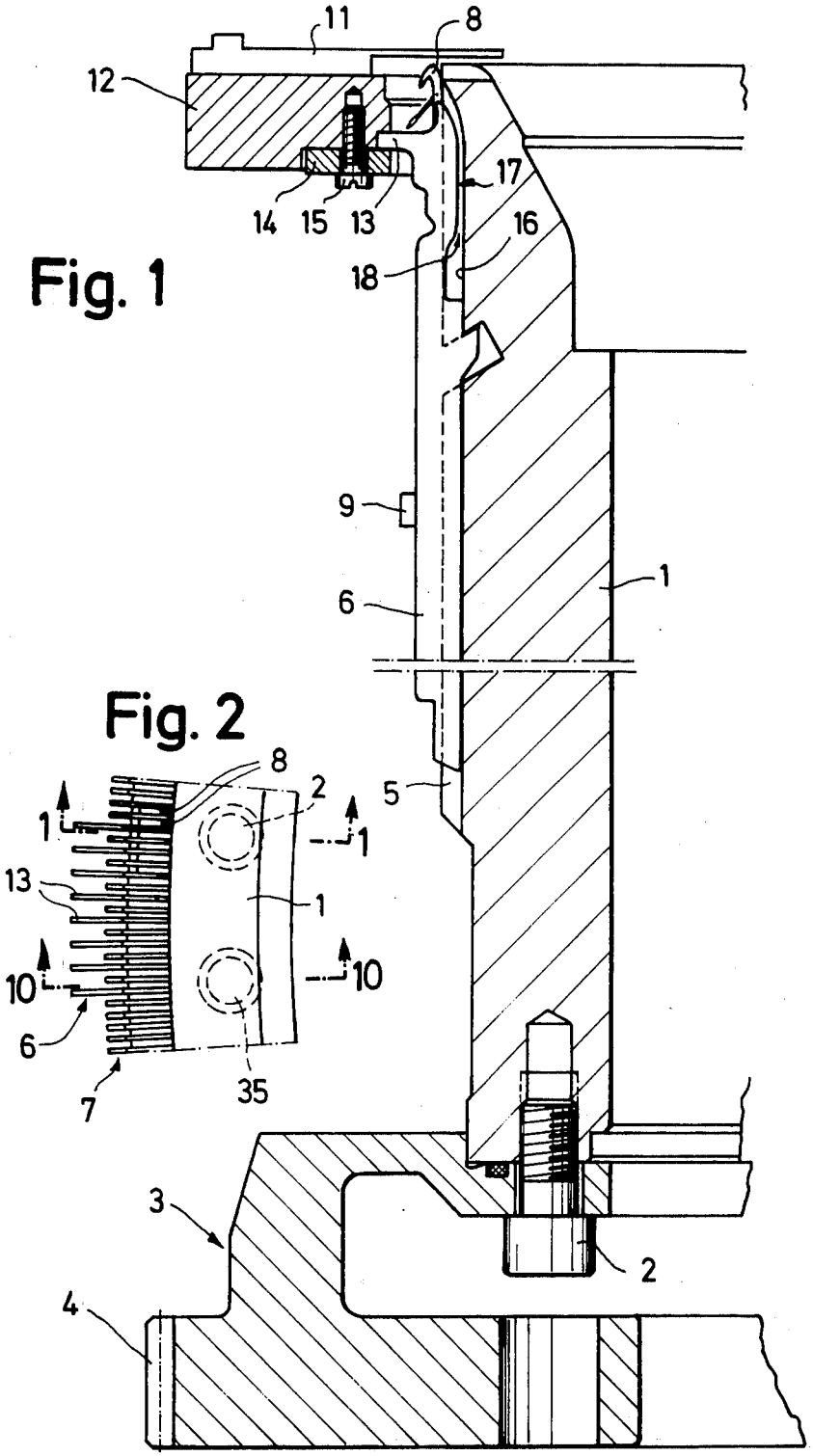
Figure 3:
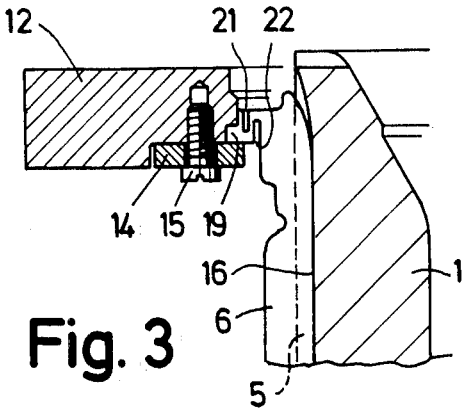
Figure 8:
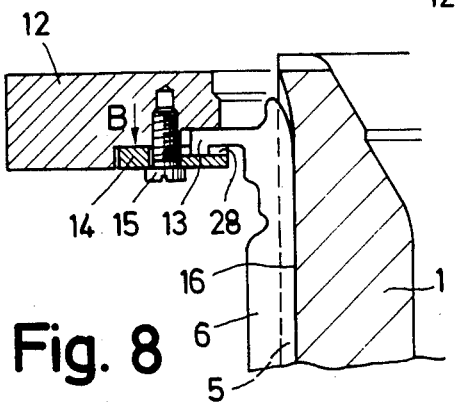
Figure 9:
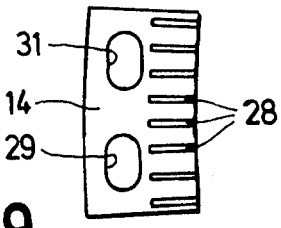
Figure 10:
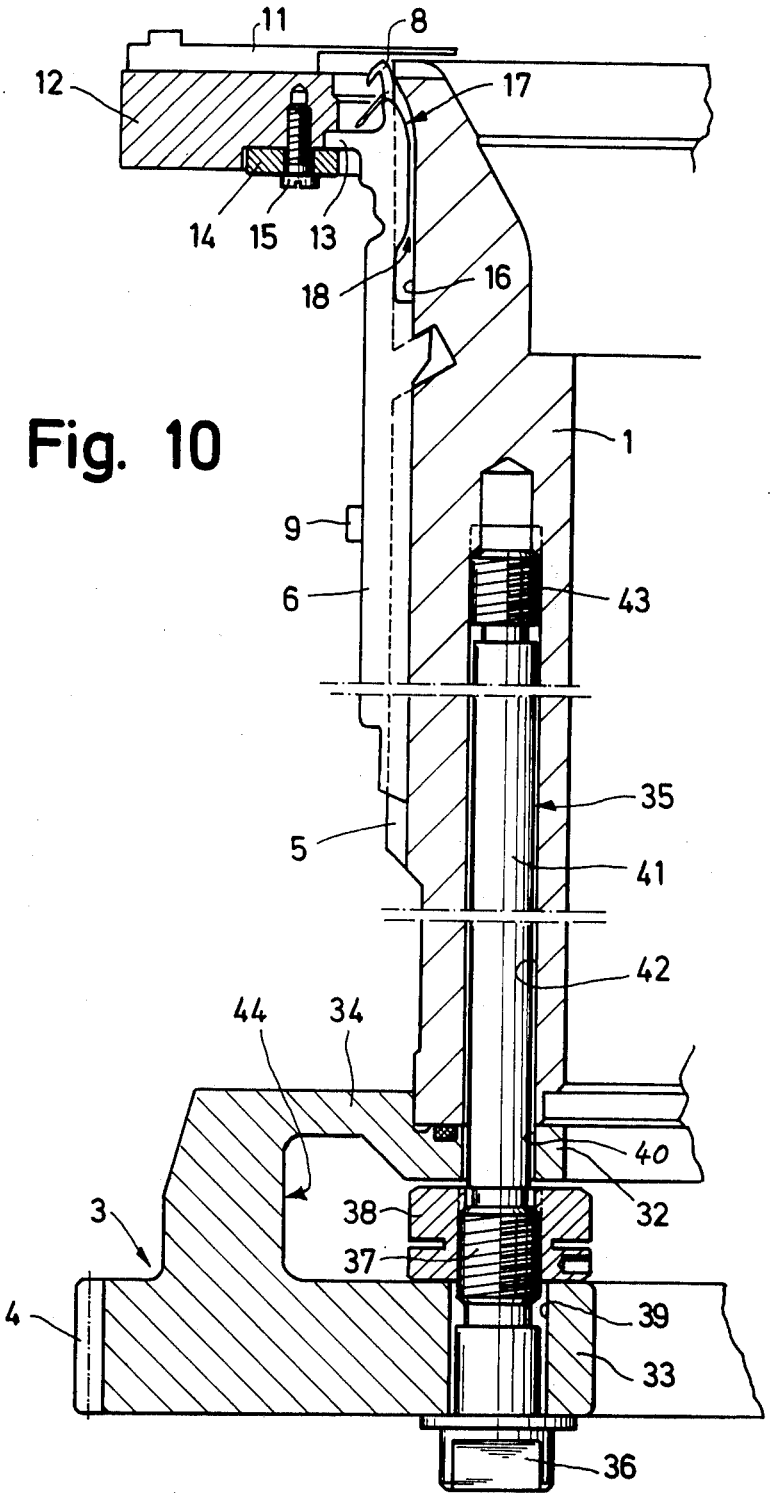

The following description of preferred embodiments of the invention serves to explain the invention in more detail in conjunction with the attached drawings which show:

FIG. 1 a part-sectional view of the needle cylinder of a circular knitting machine with sinker ring;

FIG. 2 a partial plan view of the needle cylinder shown in FIG. 1;

FIG. 3 a flexible mounting of the sinker ring on the needle cylinder;

FIGS. 4 to 9 details of various embodiments for radially displaceable arrangement of the sinker ring on the needle cylinder and FIG. 10 a part-sectional view similar to FIG. 1 with a screw bolt counteracting the axial thermal expansion of the needle cylinder.

FIG. 1 shows the needle cylinder 1 of a customary circular knitting machine connected by screws 2 to a rotatably mounted support collar 3. This collar has teeth 4 at its outer periphery. The driving pinion of a drive motor, which is not illustrated, may engage with the teeth 4 and cause the needle cylinder 1 to rotate. The needle cylinder 1 has numerous grooves 5 arranged side-by-side around its entire outer periphery. Webs 6, 7 are securely inserted into these grooves in the known manner. Grooves are also formed between every two adjacent webs and knitting needles 8 guided in these grooves in the customary way for sliding displacement. When the needle cylinder 1 is rotated, the knitting needles 8 are axially reciprocated via a needle foot 9 in the known manner by corresponding cams which are not illustrated.

When the circular knitting machine is in operation the needles 8 interact with sinkers 11 which are merely schematically illustrated in FIG. 1. These sinkers are guided for radial sliding displacement in a sinker ring 12 disposed in the top region of the needle cylinder 1. The sinker ring 12 is supported by projections 13 of webs 6 which protrude radially outwards and is held securely on these projections by claws 14 (cf. also FIG. 9) and screws 15. As shown by the plan view of FIG. 2, two types of web 6 and 7 are used. These webs differ in that webs 6 have the projections 13 described above whereas webs 7 do not. The sinker ring 12 is therefore supported only on some webs which are uniformly distributed in groups around the entire periphery of the needle cylinder 1. FIG. 2 shows such a group consisting of, altogether, eight webs 6 provided with projections 13. As illustrated, webs 7 without projections and webs 6 with projections are arranged alternately. The needle cylinder may have, for example, 12 such groups distributed around its periphery.

During operation of the circular knitting machine the needle cylinder 1 and the sinker ring 12 are subject to a high degree of heat due to the friction caused by movement of the needles 8 and sinkers 11. The temperatures thereby reached do, however, vary and thermal expansion in the top region of the needle cylinder 1 differs from that of the sinker cylinder. This may lead, in particular, to stressing and deformations of the sinker ring rigidly connected with the needle cylinder 1 which is not acceptable in such a knitting machine.

In order to remedy this problem, it is suggested that the top region of the needle cylinder be designed so that it is radially displaceable relative to the sinker ring. It is then possible to compensate for differences in the thermal expansion of needle cylinder 1 and sinker ring 12. In the embodiment illustrated in FIG. 1, a gap 18 is provided for this purpose in the top region of the needle cylinder 1 between the bottom 16 of the groove and the back 17 of the web 6 supporting the sinker ring 12. The upper part of the web 6 which bears the sinker ring 12 on its projection 13 may then move relative to the top edge region of the needle cylinder 1 due to the intrinsic elasticity of the material used for the web 6 and thus compensate for the difference in the thermal expansion of needle cylinder 1 and sinker ring 12. The sinker ring 12 is no longer deformed and the sinkers 11 retain their precise guidance and alignment.

In the embodiment illustrated in FIG. 3, the projection 19 supporting the sinker ring 12 has axially extending slits 21, 22 which enable the projection 19 to be radially and elastically deformed in relation to the needle cylinder 1 and the sinker ring 12. Radial displacement may therefore take place between the top region of the needle cylinder 1 and the sinker ring 12 to compensate for the varying thermal expansions resulting from the unequal heat to which the needle cylinder 1 and the sinker ring 12 are subjected.

Figure 4:
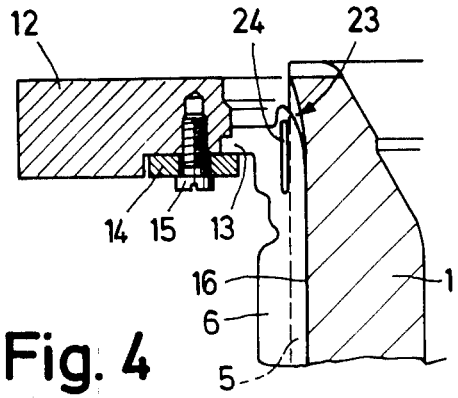

In the embodiment of FIG. 4, the differing thermal expansions of needle cylinder 1 and sinker ring 12 are compensated in a manner similar to FIG. 3 in that the part 23 of the web 6 which is arranged in the top region of the needle cylinder 1 and bears the projection 13 is provided with an elongated hole 24. The web 6 is then elastically deformable in its upper area and the needle cylinder 1 and sinker ring 12 may move relative to each other when they expand to varying degrees.

Figure 5:
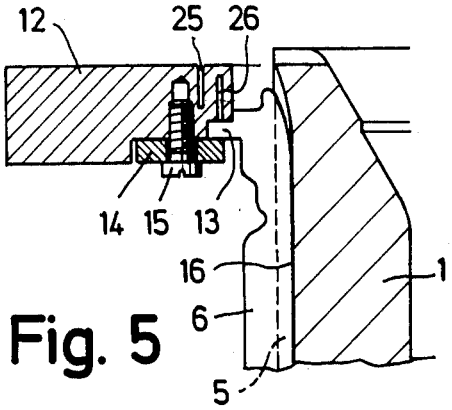

In the embodiment of FIG. 5, slits 25, 26 which are similar in function to slits 21, 22 in FIG. 3 are arranged in that region of the sinker ring 12 which faces the needle cylinder and rests on the projections 13 of the webs 6. The slits 25, 26 are in the shape of circular rings and extend concentrically to the axis of the needle cylinder 1. They allow a flexible arrangement of the sinker ring 12 on the needle cylinder 1 so that the needle cylinder 1 and the sinker ring 12 may move relative to each other. In another embodiment of the invention, the sinker ring 12 may be designed to have an elastic inner region which faces the needle cylinder 1 and is supported on the projections 13 of webs 6. This is achieved in that, instead of having slits 45, 46, this region is made from an elastomeric material, such as rubber, and connected to the actual sinker ring 12 which is made of metal.

Figure 6:
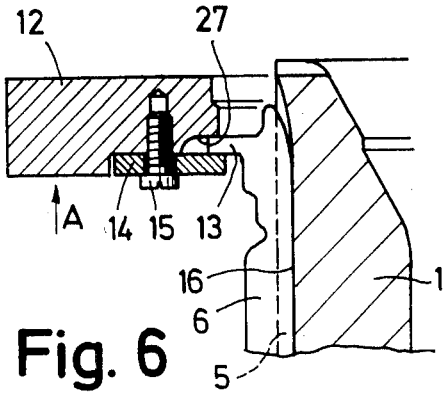
Figure 7:
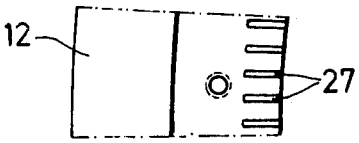

In the embodiment of FIGS. 6 and 7 (FIG. 7 is a view from below in the direction of arrow A in FIG. 6), radially extendings slits 27 are formed in the inner region of sinker ring 12 facing the needle cylinder 1. The projections 13 of webs 6 are guided in these slits for sliding displacement. In this way, it is also possible for the needle cylinder 1 and the sinker ring 12 to move relative to each other when they expand to varying degrees.

In the embodiment of FIGS. 8 and 9 (FIG. 9 is a plan view of claw 14 in the direction of arrow B in FIG. 8), the claws 14, which serve to secure the sinker ring 12 to the projections 13 of webs 6 and one of which is associated with each group of webs 6, have radially extending slits 28 in which the projections 13 may be slidingly diplaced. This achieves the same effect as the embodiment of FIGS. 6 and 7.

FIG. 9 also shows two elongated holes 29, 31 formed in each claw 14 and having, overall, a larger inside diameter than the shaft of screw 15 to allow the sinker ring 12 to be centered on the needle cylinder 1.

The above description has dealt with radial thermal expansion. It has also been found that axial thermal expansion of the needle cylinder 1 may have a disadvantageous effect on the sinker ring 12 and may, in particular, lead to an undesired lifting of the ring 12. In order to counteract axial thermal expansion of the needle cylinder 1 the embodiment of the invention shown in FIG. 10 is suggested.

As illustrated, the support collar 3 of the needle cylinder 1 consists of an annular web 32, to which the needle cylinder 1 is rigidly secured from below by screws 2 (FIG. 1). The annular web 32 is resiliently connected by an annular bridge 34 to a supporting web 33 which is rigid in itself and arranged below the annular web. Each screw bolt 35 is securely anchored in the supporting web 33 by means of a screwhead 36 and a check nut 38 seated on a thread section 37 of the screw bolt 35. The screw bolts are evenly distributed around the periphery of this supporting web. The supporting web 33 is securely clamped between screwhead 36 and check nut 38 so that the screw bolt 35, when securely anchored to the supporting web 33, projects upwards. A small gap of, for example, a few millimeters is left between the lower edge of the annular web 32 and the upper edge of the check nut 38 to allow the annular web 32 to yield freely downwards for a small distance.

The smooth shaft 41 of the screw bolt 35, which passes freely through correspondingly wide bores 39, 40 in the supporting web 33 and annular web 32, projects freely into an axial bore 42 in the needle cylinder 1. This bore has, for this purpose, a larger inside diameter than the outer diameter of shaft 41. The screw bolt 35 has at its end facing away from the supporting web 33 a thread portion 43, the diameter of which is somewhat larger than the diameter of shaft 41. This thread portion 43 serves to screw the screw bolt 35 into a corresponding internal thread of the otherwise smooth bore 42. The screw bolt 35 therefore provides a rigid connection between the supporting web 33 and the top region of the needle cylinder 1, into which the thread portions 43 of the screw bolts 35 are tightly screwed.

The screw bolts 35 are made from a metal having a considerably lower coefficient of thermal expansion than the metal used for making the needle cylinder 1. The coefficient of thermal expansion for screw bolt 35 may, for example, by approximately ten times lower than that of the needle cylinder 1. Materials suitable for the manufacture of screw bolt 35 are, for example, the nickel alloys X50Ni36 and X50Ni42 according to DIN 17006.

If needle cylinder 1 heats up and is caused to expand in axial direction, this expansion may be incurred only in a downward direction, due to the fact that the top region of the needle cylinder 1 is secured by the screw bolt 35 to the supporting web 33, and may cause the annular web 32 to yield downwardly. In the region of the screw bolt 35, such thermal expansion cannot therefore cause any upward axial displacement of the top region of the needle cylinder 1. Such upward axial displacement may be incurred, at the most, along that axial length of the needle cylinder 1 which is located above the point of connection (thread portion 43) between screw bolt 35 and needle cylinder 1. It has been found that the screw bolt 35 with its thread portion 43 may always be rigidly connected with the needle cylinder 1 at a point sufficiently high to keep any thermal expansion of the needle cylinder, which occurs in its top region situated above the area of connection between the screw bolt and the needle cylinder and is directed upwards, so small that it is practically insignificant.

The number of screw bolts 35 provided around the periphery of the support collar 3 may be, for example, six, twelve or more. Screws 2 (FIG. 1) may be arranged between these screw bolts to form a rigid connection between the annular web 32 and the needle cylinder 1. In the embodiment of the invention illustrated in FIG. 10, the annular web 32 and the supporting web 33 are integral with each other. In another embodiment of the invention, the annular web 32 and the supporting web 33 form separate parts which may be screwed together, for example at the flange part 44 of bridge 34.

In the embodiment illustrated in FIG. 10, a gap 18 is again provided between the base 16 of groove 5 and the back 17 of web 6. This serves to compensate for differences in the radial thermal expansion of needle cylinder 1 and sinker ring 12 in the manner described. In the embodiment of FIG. 10, this compensation of radial thermal expansion is accompanied by compensation of the axial thermal expansion of needle cylinder 1 by the screw bolts 35. It has been found that an excellent thermal stability may be achieved in circular knitting machines as a result of combining measures for compensating both radial and axial thermal expansion.

The stabilization of the top region of needle cylinder 1 against thermal expansion, which may be achieved with the embodiment of the invention shown in FIG. 10, is significant not only in conjunction with compensation of the differences in the thermal expansion of needle cylinder and sinker ring. The screw bolt 35 and the favourable effects achieved therewith in respect of the axial thermal expansion of needle cylinder 1 may also be used and achieved in circular knitting machines with no sinker ring 12 if axial thermal expansion of the needle cylinder is, as such, an interference.

In the embodiments of FIGS. 3 to 9, the back of web 6 rests, in contrast to FIG. 1, directly on the base of groove 5 which is milled into the needle cylinder 1 and receives the web. In contrast to the embodiment of FIG. 1, the upper part of web 6 may not therefore yield resiliently and enable the needle cylinder and sinker ring to move relative to each other. This movement is brought about, as described above, by the other measures illustrated in FIGS. 3 to 9. With this invention it is, however, also possible to combine the features of FIGS. 3 to 9 with the gap 18 of FIG. 1 to achieve an even greater radial flexibility between needle cylinder and sinker ring. The features of FIGS. 3 to 9 may, of course, also be combined with the screw bolt 35.

We claim:

1. A circular knitting machine comprising a needle cylinder 1, axially parallel grooves 5 in said needle cylinder, webs (6, 7) arranged in said grooves (5), needles (8) displaceable between said webs (6, 7), projections (13) projecting radially outwards from said webs (6), a sinker ring (12) supported on said projections (13), means (14, 15) for securing said sinker ring (12) on said projections (13) and sinkers (11) guided in said sinker ringer (12) for sliding displacement, characterized in that free spaces (18; 21, 22; 24; 25, 26; 27; 28) are provided between needle cylinder (1) and sinker ring (12) on a level with the projections (13) supporting said sinker ring (12) to allow radial movement of needle cylinder (1) and sinker ring (12) relative to one another at the level of said projections (13) so that differences in the thermal expansion of needle cylinder (1) and sinker ring (12) may be compensated at the level of said projections (13) without mechanical stresses occurring between needle cylinder (1) and sinker ring (12).

2. Circular knitting machine as defined in claim 1, characterized in that the spaces (18) are provided in the top region of the needle cylinder (1) between the bases (16) of the grooves (5) and the backs (17) of the webs (6).

3. Circular knitting machine as defined in claim 1, characterized in that the spaces are designed as slits (21, 22) in the projections (13) of the webs (6) bearing the sinker ring (12) and said projections (13) are thereby radially and elastically deformable.

4. Circular knitting machine as defined in claim 1, characterized in that the spaces are designed as elongated holes (24) in the region (23) of the webs (6) bearing the projections (13) and said webs (6) are thereby radially and elastically deformable in said region (23).

5. Circular knitting machine as defined in claim 1, characterized in that the spaces are designed as annular slits (25, 26) in the inner area of the sinker ring (12) facing the needle cylinder (1) and said area is thereby radially and elastically deformable.

6. Circular knitting machine as defined in claim 1, characterized in that the spaces are designed as radially extending slits (27) in the inner area of the sinker ring (12) facing the needle cylinder (1) and the projections (13) of the webs (6) are slidingly displaceable in said slits (27).

7. Circular knitting machine as defined in claim 1, characterized in that the spaces are designed as radially extending slits (28) in the means (14) for securing the sinker ring (12) and the projections (13) of the webs (6) are slidingly displaceable in said slits (28).

8. Circular knitting machine as defined in claim 1, characterized in that a support collar (3) supporting the needle cylinder (1) has an annular web (32) rigidly secured to said needle cylinder (1) has an annular web (32) rigidly secured to said needle cylinder (1) and resiliently connected to a supporting web (33) which is rigid in itself and located beneath said annular web, and that screw bolts (35) having a substantially lower coefficient of heat expansion than said needle cylinder (1) are securely anchored in said supporting web and distributed around its periphery, said screw bolts extending freely through axial bores (42) in said needle cylinder, the ends (43) of said screw bolts which face away from said supporting web (33) being tightly screwed into the top region of said needle cylinder (1).

9. Circular knitting machine as defined in claim 8, characterized in that the screw bolt (35) is made from a material having a coefficient of heat expansion which is approximately ten times lower than that of the material used for the needle cylinder (1).

10. Circular knitting machine as defined in claim 8, characterized in that the screw bolt (35) is securely anchored to the supporting web (33) by a check nut (38).

11. Circular knitting machine as in claim 9 characterized in that the screw bolt (35) is securely anchored to the supporting web (33) by a check nut (38).

* * * * *